United States Patent [19]

Zapf et al.

[11] 4,452,486

[45] Jun. 5, 1984

[54] CHAIR TYPE FURNITURE

[76] Inventors: Otto Zapf, Ölmühlweg 33B, D-6240 Königstein; Josef Kuchinke, Untergasse 7, D-6730 Oberursel 6, both of Fed. Rep. of Germany

[21] Appl. No.: 304,374

[22] Filed: Sep. 22, 1981

[30] Foreign Application Priority Data

Sep. 24, 1980 [DE] Fed. Rep. of Germany ... 8025516[U]

[51] Int. Cl.[3] ..... A47C 1/02

[52] U.S. Cl. ..... 297/343; 297/317; 297/341

[58] Field of Search ..... 297/343, 342, 68, 85, 297/341, 317, 318

[56] References Cited

U.S. PATENT DOCUMENTS

| | | | |
|---|---|---|---|
| 677,234 | 6/1901 | Kelly | 297/343 |
| 1,928,857 | 10/1933 | Kelly | 297/343 |
| 2,374,848 | 5/1945 | Wohlk | 297/343 |
| 2,423,816 | 7/1947 | Renkes | 297/343 |

FOREIGN PATENT DOCUMENTS

| | | | |
|---|---|---|---|
| 494351 | 7/1953 | Canada | 297/343 |
| 570116 | 12/1957 | Italy | 297/341 |

*Primary Examiner*—James T. McCall

*Attorney, Agent, or Firm*—Lackenbach, Siegel, Marzullo, Presta & Aronson

[57] ABSTRACT

The invention relates to a chair type furniture characterized by a frame on which a seat area may be guided forward and backward in about horizontal direction, furtheron by a tiltable back rest the lower end of which is articulated to the seat area the middle range of which seat area is articulated to the frame, which back rest is guidedly displaceable together with the seat area and at the same time is tilted around the joint on the frame thus causing a spring element to pull the seat area and the back rest into a neutral position, in which the seat area is in its rear position and the back rest is in its most upright position, wherein in order to provide the swivel connection between the seat area and the lower end of the back rest a first bar is tiltably articulated with its lower end to the frame and with the upper end is also tiltably articulated to the back rest, and wherein a second bar is articulated with one end to the first bar and with the other to the seat area.

4 Claims, 3 Drawing Figures

CHAIR TYPE FURNITURE

The present invention relates to a chair type furniture characterized by a frame on which a seat area may be guided forward and backward in about horizontal direction, furtheron by a tiltable back rest the lower end of which is articulated to the seat area the middle range of which seat area is articulated to the frame, which back rest is guidedly displaceable together with the seat area and at the same time is tilted around the joint on the frame thus causing a spring element to pull the seat area and the back rest into a neutral position, in which the seat area is in its rear position and the back rest is in its most upright position.

A chair type furniture of this sort has been described by French Patent Specification No. 1,993,433. In that case, the lower edge of the back rest is articulatedly connected to the rear edge of the seat area. If now the seat area is moved by the user of the furniture from the neutral position mentioned into the forward direction, the back rest will at the same time be more flatly reclined relative to the horizontal thus providing for a comfortable rest position.

The disadvantageous feature however is that in the course of this movement from the neutral position into the rest position a relative displacement between the back rest and the user's back is experienced such that along the user's back an upright directed force is exerted, which is noted as unpleasant on one side and engages particularly at the user's garments, which are pulled upward, on the other.

A remedy was developed by Otto Zapf's U.S. patent application, Ser. No. 130,136, filed Mar. 13, 1980, which avoids already these disadvantageous effect in that the back plate includes a subdivided auxiliary plate the lower end of which is articulated to the seat area. The structure of this prior art application is moreover characterized in that the user's lumbar region is well supported in any position on this chair type furniture. With a view to the additional subdivided plate, however, this structure is relatively expensive in production.

SUMMARY OF THE INVENTION

It is therefore the aim of the present invention to provide a chair type furniture where the user starting from an upright neutral position may selectively take a more fully reclined rest position and all intermediate positions or vice versa, respectively, while the chair type furniture is simple in structure and during the course of the displacement practically no forces are exerted between the back rest and the user's back.

Starting from a chair type furniture of the kind mentioned in the beginning, the solution of this problem is found in accordance with the present invention in that in order to provide the swivel connection between the seat area and the lower end of the back rest a first bar is tiltably articulated with its lower end to the frame and with the upper end is also tiltably articulated to the back rest and that a second bar is articulated with one end to the first bar and with the other to the seat area.

When tilting the back rest as mentoned from the neutral position into the rest position, the lower end of it is guided in an essentially circular movement via the first bar this movement being superimposed by the down movement of the back rest on the frame. The superposition of these two movements causes that practically no forces are exerted between the back rest and the user's back or his garments, respectively. The second bar transfers the forces between the back rest and the seat area, and this not directly but rather via the first bar. As different from the example according to the French patent specification discussed in the beginning, the lower end of the back rest is not directly articulated to the lower edge of the seat area but both plates are rather articulated relative to each other via the first and the second bars. Between the lower edge of the back rest and the seat area there is, according to the invention, a larger or smaller gap in the neutral position. The larger the gap, the more may the back rest be reclined until finally its lower edge contacts the upper side of the seat area.

First and second bars should be provided in the same arrangement on both sides of the back rest and of the seat area.

A particularly advantageous transfer of forces is experienced if the joint between the first bar and the second bar is provided in the upper half of the first bar.

It is of advantage for a structurally simple embodiment of the joint between the frame and the back rest if a rail is secured to the rear side of the back rest at which rail a second rail is guided, which is secured to a joint, which on its turn is secured to a joint. By this simple design it becomes possible to tilt the back rest on the frame and at the same time displace it relative to the frame in parallel thereto. The second rail mentioned may be relatively short. The first rail should be as long as the respective angle of displacement requires.

The guides of the seat area on the frame are similarly shaped, that is also by two telescoped rails. One rail pair each of this sort is provided on each side of the seat area or the frame, respectively.

The invention will now be described in more detail based on an exemplified embodiment, from which further essential features may be taken.

Figure 1:
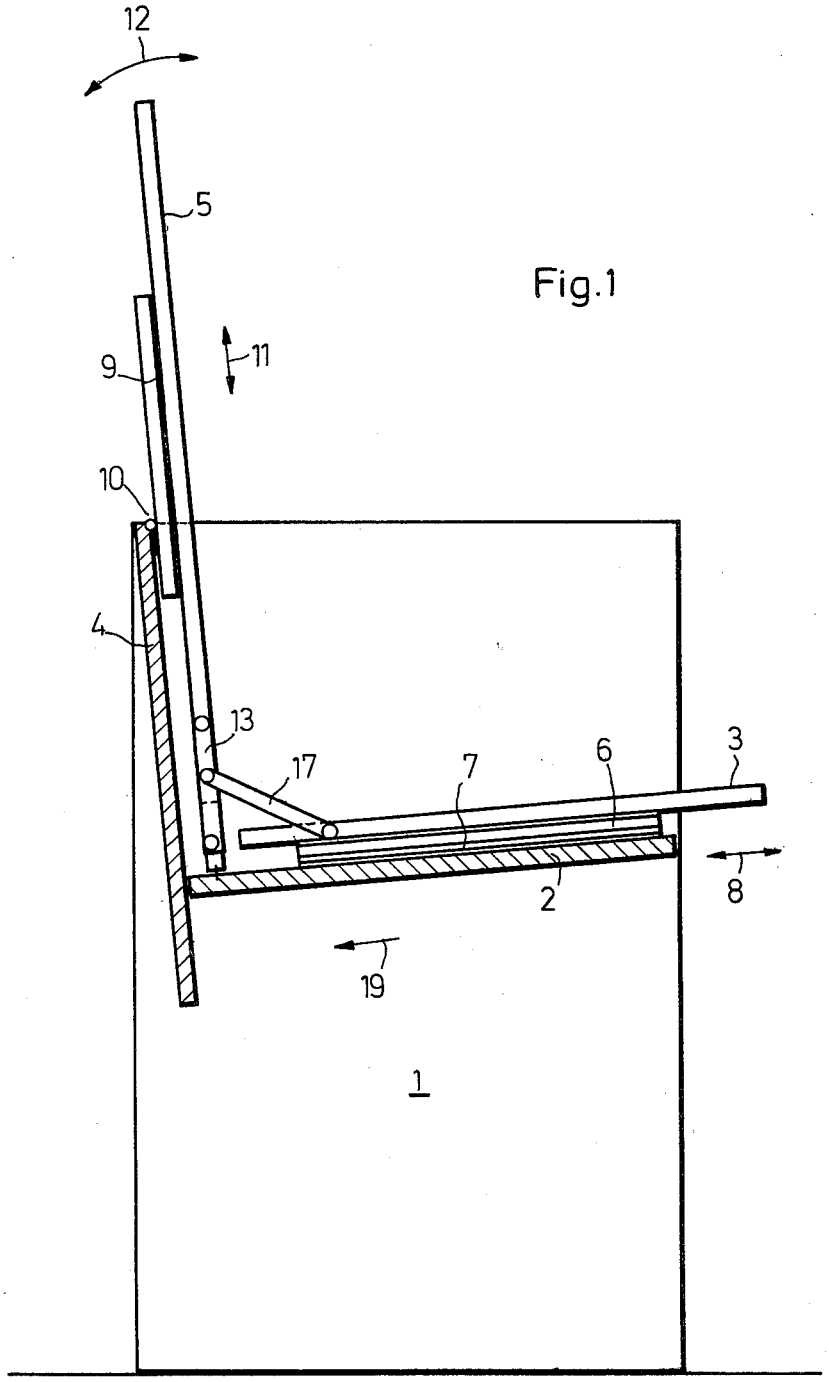
FIG. 1 shows a schematic view of the essential elements of a novel chair type furniture in the upright neutral position as mentioned.

The novel chair type furniture comprises a frame 1 of any desired shape. To this frame, a first guide plate 2 for the seat area 3 and a second guide plate 4 for a back rest 5 is secured. At the lower side of seat area 3, a guide rail 6 is secured engaging into a guide rail 7 secured to the upper side of guide plate 2. This permits moving the seat area 3 about horizontally backward or forward, respectively, in the direction of the double arrow 8.

To the rear side of back rest 5, a guide rail 9 is secured into which engages a joint 10 having an extension or a further guide rail. This makes possible that back rest 5 may also be displaced in the direction of double arrow 11 in the level of back rest 5. Joint 10 is pivotingly secured to the upper edge of guide plate 2. This makes possible that back rest 5 may also be tilted in the direction of double arrow 12 around joint 10. The back rest constitutes an undivided plate.

The transfer of force between the back rest 5 and the seat area 3 is effected via a first bar 13, on one hand, at the lower end of which a joint 14 is provided by which the first bar is articulated to frame 1. The upper end of first bar 13 is articulated via a joint 15 to back rest 5. About in the middle between joints 14 and 15, a further joint 16 is provided by which a second bar 17 is pivoted to first bar 13. The other end of second bar 17 is secured via a joint 18 to the seat area 3.

The system comprising first bar 13 and second bar 17 is identically provided on both sides of the seat area 3 and back rest 5. In addition thereto, a spring element, preferably a gas spring, is advantageously provided engaging on seat area 3 and trying to pull the latter in the direction of arrow 19 into the neutral position according to FIG. 1.

Figure 2:
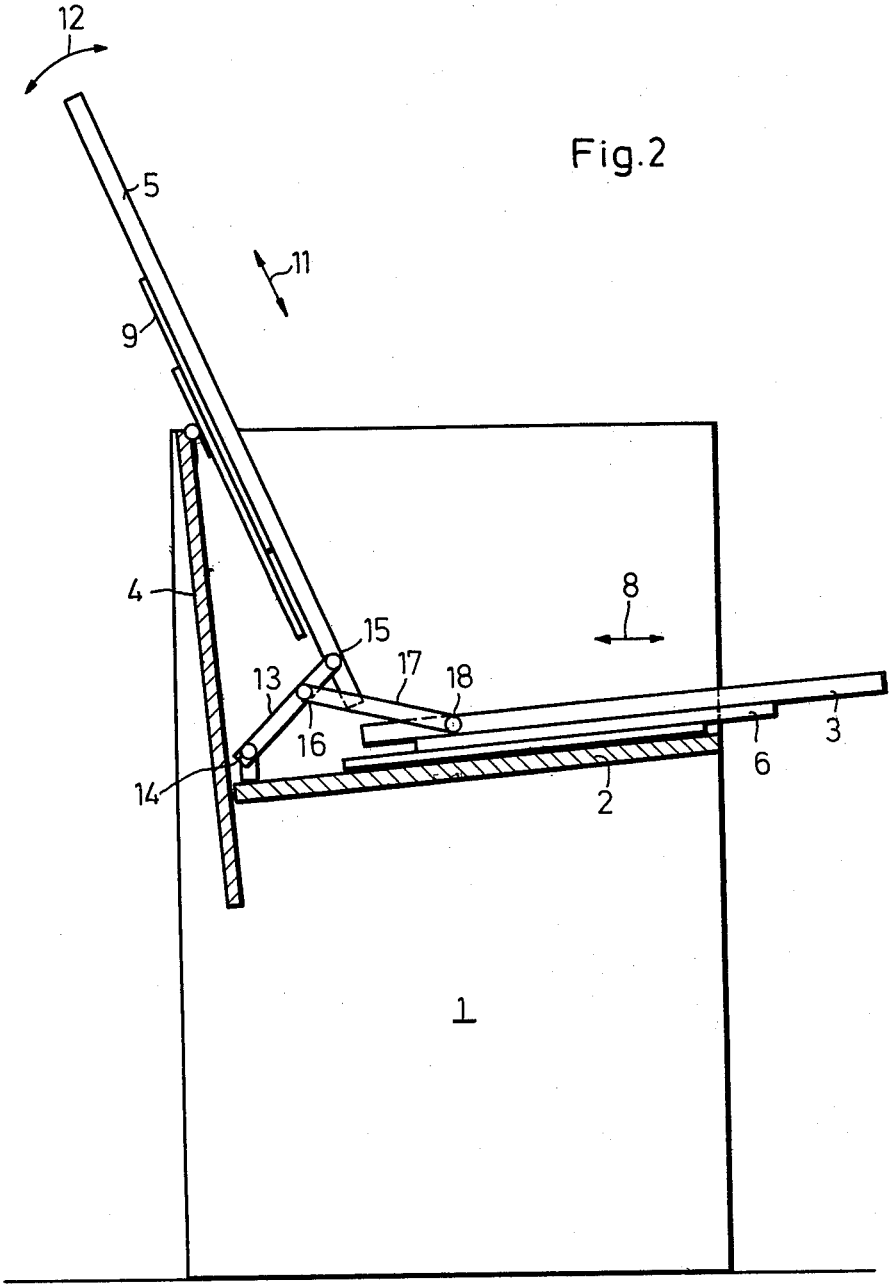
FIG. 2 shows a lateral view according to FIG. 1 in the rest position of the chair type furniture.
Figure 3:
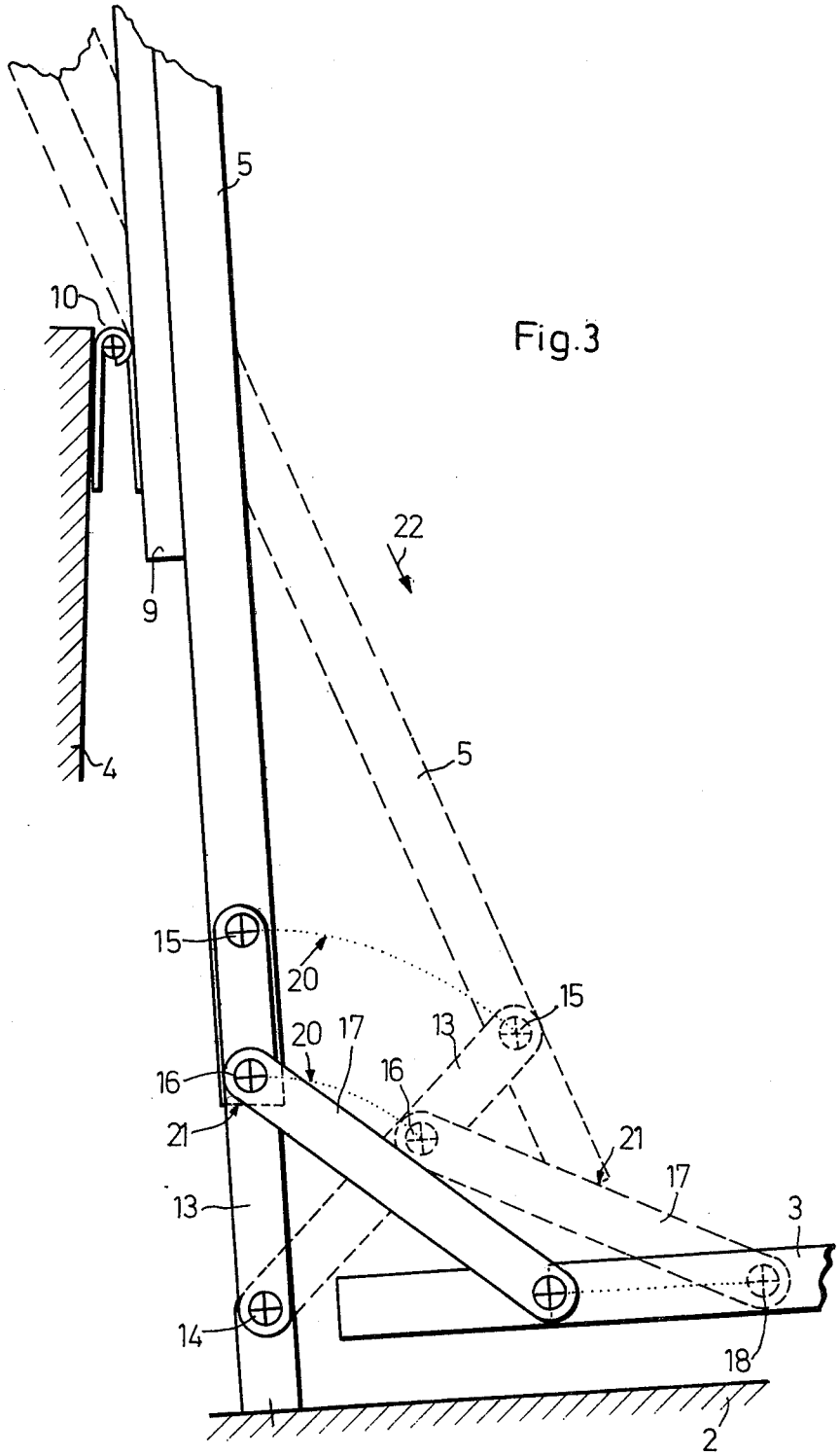
FIG. 3 shows, in an enlarged view, the pivot connection between the back rest and the seat area in the chair type furniture according to FIGS. 1 and 2, the solid lines showing the neutral position and the dotted lines showing the rest position.

If starting from the neutral position according to FIG. 1, a more comfortable rest position according to FIG. 2 is desired, the user presses with his back against the upper portion of back rest 5, which is above joint 10 thus causing back rest 5 to tilt into the direction of arrow 12 into the more reclined position according to FIG. 2. In this case, the joints 15 and 16 of first bar 13 move on orbits 20 the center of which corresponds to joint 14. This rotating motion is transferred via second bar 17 into a forward-directed movement (contrary to the direction of arrow 19) of seat area 3. The lower end 21 of back rest 5 performs a movement composed of the circular movement of joint 15 and a further movement superimposed on this movement, by which back rest 5 is displaced downward in parallel relative to it in the direction of arrow 22. The superposition of these two forces effects that the user sitting on this chair type furniture does not perceive any forces, which are being transferred from the back rest onto his back or his garments, repsectively.

In the neutral position according to FIG. 1, a distance is provided between the lower end 21 of the back rest 5 and the upper side of seat area 3. The larger the distance, the more may the back rest be reclined and the more can the seat area be moved forward. Experiments have shown that even in case of a relatively small distance of a few centimeters, sufficient inclination is possible. The distance will therefore be selected in accordance with the requirements as to the inclination of this chair type furniture.

We claim:

1. A reclinable chair comprising;

a frame;

a seat portion, means to guide said seat portion in a horizontal direction forwardly and backwardly;

a backrest, means to guide said backrest in relation to said frame; and further comprising a joint interconnecting said backrest to said frame;

articulation means to move said seat portion and backrest in relation to said frame;

a spring being interconnected to said seat so as to pull said seat portion in its guide means and, in turn, said back rest in its guide means to a neutral position whereat said seat portion is in its rearward position and the back rest is in its upright position;

said articulation means comprising a first bar being pivotally connected at its lower end to said frame and pivotally connected at its upper end to said backrest, and a second bar pivotally connected at one end to said first bar and at the other end to said seat portion; whereby said chair is displaceable from the neutral position to a reclined rest position with practically no forces being exerted between the backrest and the user's back and with continuous support of the lumbar region of the user, and then being returnable to said neutral position.

2. A chair type furniture characterized by:

a frame (2);

a seat (3) being slidably positioned at that frame (2) essentially in its forward and backward direction (8);

a back rest plate (5) being slidably and tiltably fastened to the frame (2);

a linking means (13, 17) being provided and connecting a rear part of said seat (3) with a lower part of said back rest plate (5);

a biasing means being provided for biasing the arrangement of the seat (3) and the back rest plate (5) in a neutral position, in which the seat (3) is in its rearmost position and the back rest plate (5) is in its most upright position;

a vertical distance being provided in the neutral position between a lower edge (21) of said back rest plate (5) and the upper surface of the seat (3); and the arrangement being such that when moving the seat (3) and the back rest plate (5) linked to the seat from the neutral position in a more forward and more inclined position of the seat (3) and the back rest plate (5), respectively, the lower part of the back rest plate (5) is making a movement being superimposed by a first and a second movement, said first movement (20) essentially being directed in the forward direction of the seat (3) and the second movement (22) essentially being directed downwardly, such that by these superimposed movements the lower part of the back rest plate (5) permanently is supporting the lumbar region of a person sitting on the chair type furniture essentially without exerting any force between the lower part of the back rest plate (5) and said person.

3. Chair type furniture according to clam 2, wherein rails (9) are secured to the rear side of said back rest (5), which are pivotally secured to a joint (10), which on its hand is secured to said frame (2).

4. Chair type furniture according to claim 1, wherein said second bar comprises a joint provided between said first bar and said second bar in the upper half of said first bar.

* * * * *